United States Patent [19]

Wolters

[11] Patent Number: 4,966,000

[45] Date of Patent: Oct. 30, 1990

[54] INTERNAL COMBUSTION ENGINE WITH FLUID DRIVE OUTPUT

[76] Inventor: Clemens A. Wolters, 6816 Ray Rd., Raleigh, N.C. 27613

[21] Appl. No.: 471,873

[22] Filed: Jan. 29, 1990

[51] Int. Cl.[5] ..... F02B 71/04

[52] U.S. Cl. ..... 60/595

[58] Field of Search ..... 60/595

[56] References Cited

U.S. PATENT DOCUMENTS 3,119,230 1/1964 Kosoff ..... 60/595

4,702,205 10/1987 David ..... 60/595 X

*Primary Examiner*—Allen M. Ostrager

*Attorney, Agent, or Firm*—Mueller and Smith

[57] ABSTRACT

An internal combustion engine is provided wherein paired free pistons are driven within opposed piston chambers of a cylinder to drive a fluid which, in turn, is introduced to the fluid drive chambers of a vane-type rotor assembly. The rotor assembly includes a hub containing an array of vanes which wipe across a rotor housing internal profile. The structuring of the rotor is such that the engine components may be formed in modular fashion and coupled in tandem for a combined serial drive output.

13 Claims, 4 Drawing Sheets

3
3
10
50
34
40
20
54
52
58
30
56
26
30
16
114
118
120
30'
30'
84
88
90
80
86
78
174
126
92
124
94
176
72
136
74
70
134
138
102
98
96
100
104
140
88
132
108
116
12
112
144
82
120
90
118
88
114
14
84

FIG. 2
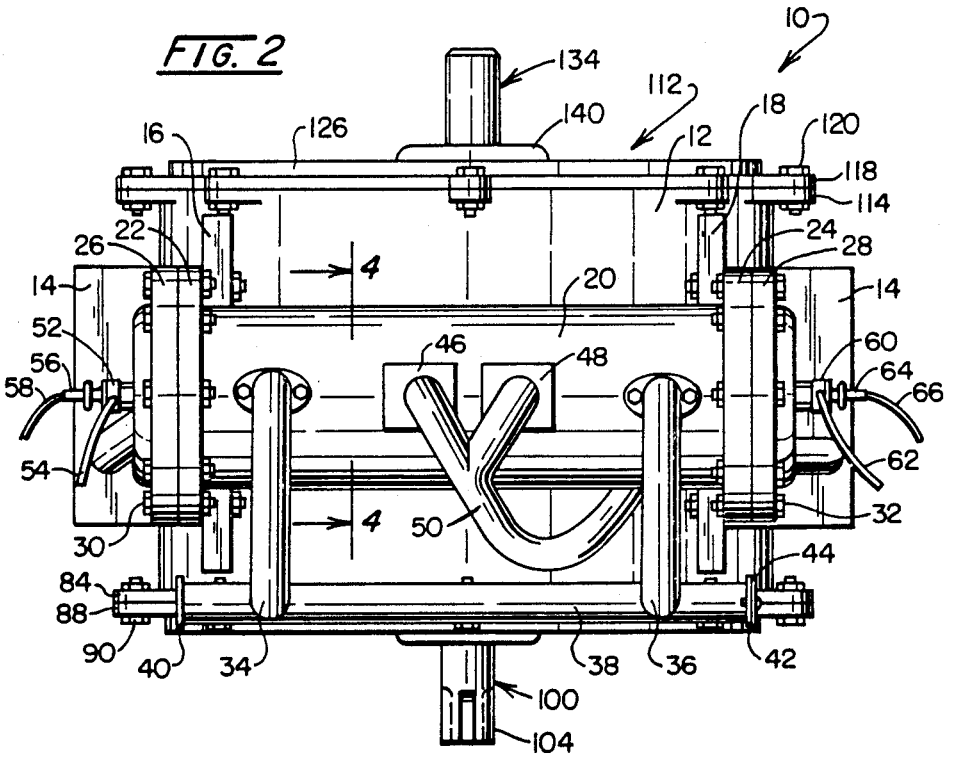
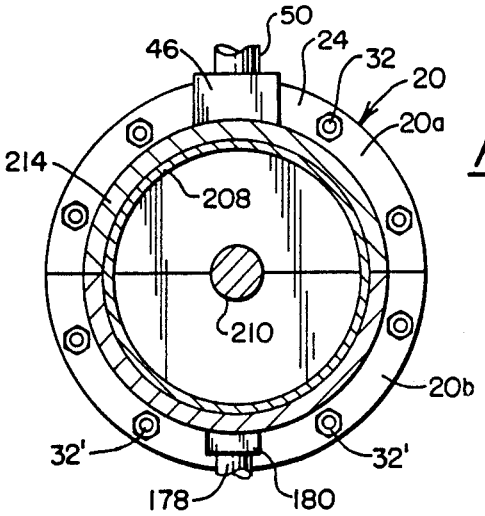
FIG. 4

INTERNAL COMBUSTION ENGINE WITH FLUID DRIVE OUTPUT

BACKGROUND

At the turn of the century, the external combustion engine was replaced for many applications, such as the automobile, with engines of the internal combustion variety. Spurred by the availability of liquid fuels, engine structures such as the Otto (1876) four stroke engine, with fuel-air compression and spark ignition utlimately dominated the automotive and other fields. Diesel (1892) introduced the compression-ignition diesel cycle engine with fuel injection, while Clerk (1878) developed the two-stroke cycle in an effort to improve the weight-to-power ratio of engines and achieve some valve simplification. The former ratio is improved inasmuch as two-stroke cycling doubles the number of power strokes otherwise developed in a four-stroke system. To accommodate for the exhaust stroke otherwise provided in a four cycle architecture, the two-cycle engine generally employs a scavenging exhaust technique. Several scavenging variations have been developed, for example, cross-scavenging including piston carried deflectors, loop scavenging and through or uniflow scavenging. See generally in this regard, "Internal Combustion Engines and Air Pollution" by E. F. Obert, 1973, Harper & Row, Publishers, Inc.

In any of the above-noted internal combustion systems, a variety of accoutrements or peripheral support systems are necessitated. The timed valving and associated camshaft assembly are called for in stroke definition. Pistons reciprocate in conjunction with crankshaft assemblies which, in turn, are lubicated from a reservoir and driven oil pump system circulating lubricating oil. Cooling generally calls for a radiator and associated water pump with cooling jacket structure about the engine cylinders. All of these peripheral components call for continuous maintenance and represent friction factors or drag in weight. The latter aspect impairs attempts to improve output power to weight ratios. Significant efforts have been put forth by investigators to overcome the necessity for many of these peripheral devices. For example, rotary engines such as those developed by Wankel (1970) perform with essentially one moving part, a rotor, and achieve higher power-to-weight ratios but at fuel efficiency losses. Ceramic structures continue to be investigated for the promise of high temperature performance without cooling systems. However, suitable ceramic materials have yet to be identified. The compounding of engines and processes such as free piston systems have been proposed, however, with no particular commercial success, due principally to cost factors.

A prominent cost factor associated with engine structuring resides in a necessary customization of design to a given application. For instance, power requirements from lesser to greater are met by generally unique, custom engine designs with corresponding customization of peripheral support equipment. No effective modularity has been introduced for upscaling or downscaling engine structures to meet different applications.

SUMMARY

The present invention is addressed to an internal combustion form of engine wherein a dual piston pump drive is combined with a hydraulically driven rotor to develop a rotational drive output. The invention avoids many of the peripheral support appliances of typical engines, for example having no camshaft, no crankshaft, or oil pump and the like which would otherwise detract from its available power-to-weight ratio. Further, the design exhibits attributes of reduced maintenance. Because of a combining of hydraulic output drive with the internal combustion pump action, the engine may be structured in a modular fashion such that two or more engines are readily combined in series drive to meet higher output requirements.

Another feature of the invention is the provision of an internal combustion engine which comprises a fluid drive component having a rotor housing with a rotor receiving portion including a substantially continuous peripheral, internally disposed contact surface. A rotor having an axis of rotation is mounted within the rotor receiving portion and is configured with respect thereto to provide first and second spaced fluid drive chambers along the contact surface thereof. A drive shaft arrangement is provided for supporting the rotor for rotation about the axis of rotation and has a drive output. First and second entrance ports and first and second exit ports are arranged in fluid communication respectively with the first and second fluid drive chambers and a fluid return arrangement is provided for receiving fluid from the first and second exit ports. An internal combustion component is provided which includes a cylinder housing have first and second oppositely disposed piston chambers, each extending from retracted positions to respective first and second head locations. First and second pistons are slideably mounted within the respective first and second piston chambers, each of the first and second pistons having a combustion driven portion and an oppositely disposed pump portion, each pump portion of the first and second pistons being movable to and from the cylinder retracted position to define respective first and second fluid pump regions. A connector rod connects the first and second pistons through the noted retracted positions and first and second internal combustion arrangements provide an internal combustion drive to the combustion drive portions of the first and second pistons to impart a reciprocating drive thereto. A conduit arrangement provides fluid flow from the fluid return arrangement to the first and second fluid pump regions when one of the first and second pistons is driven from a retracted position, and provides drive fluid flow from one of the first and second fluid pump regions to a respective first and second fluid drive component fluid drive chamber when one of the respective first and second pistons is driven toward a retracted position to impart driven rotational motion to the rotor.

Another feature of the invention provides an assembly of two internal combustion engines having tandem coupled output drives. A first fluid drive component is provided with this assembly which includes a first rotor support having a first driven axis and extending between first and second edge regions at oppositely disposed sides thereof, each side having a receiving surface of mutually corresponding profile, the first rotor support housing having a first rotor receiving portion positioned therewithin. A first end cover encloses one of the first rotor support housing sides and has a first alignment component extending from the inwardly disposed surface thereof in aligning adjacency with the receiving surface of the first rotor support housing first edge region, a first shaft opening, and a first bearing supported about the first shaft opening in coaxial alignment with the first given axis. A first rotor having first and second oppositely disposed sides, a rotor axis, and being drivably rotatable about that axis within the first rotor receiving portion and is configured with respect thereto to provide first and second spaced fluid drive chambers along the first rotor receiving portion, the first rotor second side including a first shaft coupling portion. A first drive shaft is provided which is coupled to the first side of the first rotor coaxially with the first rotor axis, rotatably supported by the first bearing to support the first rotor with coaxial alignment between the first given axis and the rotor axis of the first rotor and extending a predetermined distance to a first engaging shaft end portion. A second end cover is provided which encloses the opposite first rotor support housing side, having a second alignment component extending in aligning adjacency with the internal receiving surface of the first rotor support housing edge region, a third alignment component extending oppositely from the second alignment component and configured to correspond with the first alignment component, a second shaft opening, and a second bearing supported about the second shaft opening in coaxial alignment with the first given axis. A first internal combustion driven pump is provided which includes a first cylinder housing having first and second oppositely disposed piston chambers, first and second pistons mounted for movement within respective first and second piston chambers, a first conduit arrangement in fluid communication between the first and second piston chambers, and the first and second fluid drive chambers for configuring the first cylinder housing as a pump providing fluid drive to the first rotor, and a first internal combustion arrangement coupled with the first cylinder housing for providing combustion induced drive to the first and second pistons to effect the fluid drive. A second fluid drive component is provided within the assembly which includes a second rotor support housing having a second given axis and extending between third and fourth edge regions at oppositely disposed sides thereof, each side having a receiving surface of mutually corresponding profile corresponding with the first and second edge region profiles, the second rotor support housing having a second rotor receiving portion positioned therewithin and being coupled in coaxial relationship with the first rotor support housing by union of the third edge region with the second end cover and the third alignment component. A second rotor is provided having oppositely disposed third and fourth sides, a rotor axis, and is drivably rotatable within the second rotor receiving portion and configured with respect thereto to provide third and fourth spaced fluid drive chambers along the second rotor receiving portion, the second rotor fourth side including a second shaft coupling portion. A second drive shaft is coupled to the third side of the second rotor coaxially with the second rotor axis, is rotatably supported by the second bearing of the second end cover, and extends a predetermined distance to a second engaging shaft end portion, the second engaging shaft end portion being coupled with the first shaft coupling portion of the first rotor to support the first and second rotors in axial alignment. A third end cover encloses the second rotor support housing at the fourth edge region, has a fourth alignment component extending from the inwardly disposed surface thereof in aligning adjacency with the receiving surface of the second rotor support housing fourth edge region, a third shaft opening, and a third bearing supported about the third shaft opening in axial alignment with the rotor axis of the second rotor. A third drive shaft is coupled to the fourth side of the second rotor at the second shaft coupling portion, is rotatably supported by the third bearing to support the second rotor with coaxial alignment between the second given axis and the axis of the second rotor. The second internal combustion driven pump is provided which includes a second cylinder housing having third and fourt oppositely disposed piston chambers, third and fourth pistons mounted for movement within respective third and fourth piston chambers, a second conduit arrangement in fluid communication between the third and fourth piston chambers and the third and fourth drive chambers for configuring the second cylinder housing as a pump providing fluid drive to the second rotor, and a second internal combustion arrangement coupled with the second cylinder housing for providing a combustion induced drive to the third and fourth pistons to effect the fluid drive.

Other objects of the invention will, in part, be obvious and will, in part, appear hereinafter.

The invention, accordingly, comprises the apparatus and system possessing the construction, combination of elements, arrangement of parts and steps which are exemplified in the following detailed description.

For a fuller understanding of the nature and objects of the invention, reference should be had to the following detailed description taken in connection with the accompanying drawings.

BRIEF DESCRIPTION OF THE DRAWINGS

FIG. 2 is a top view of the engine of FIG. 1;

FIG. 4 is a sectional view of a component of the engine of FIG. 2 taken through the plane 4—4 therein.

DETAILED DESCRIPTION

Figure 1:
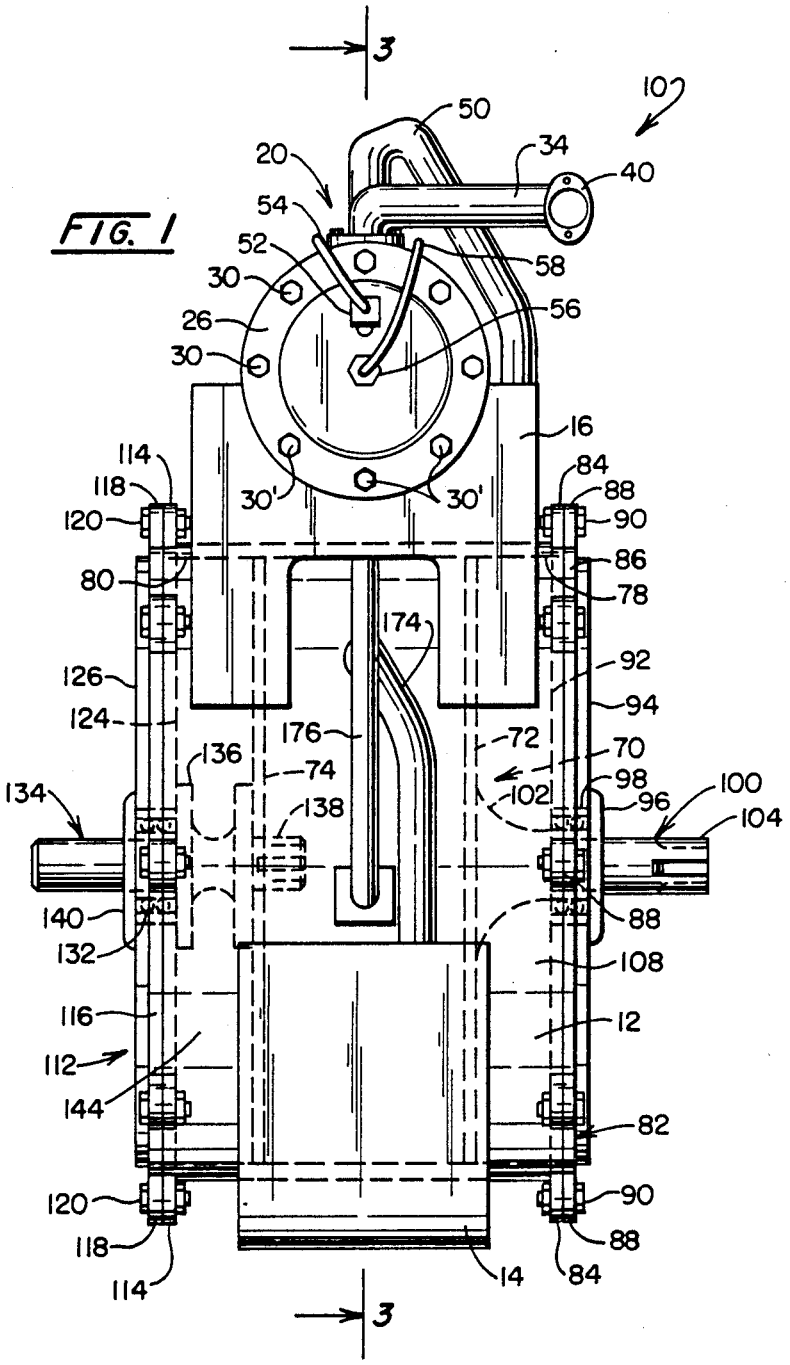
FIG. 1 is a side elevational view of an internal combustion engine module according to the invention with portions shown in phantom to reveal internal structure.
Figure 3:
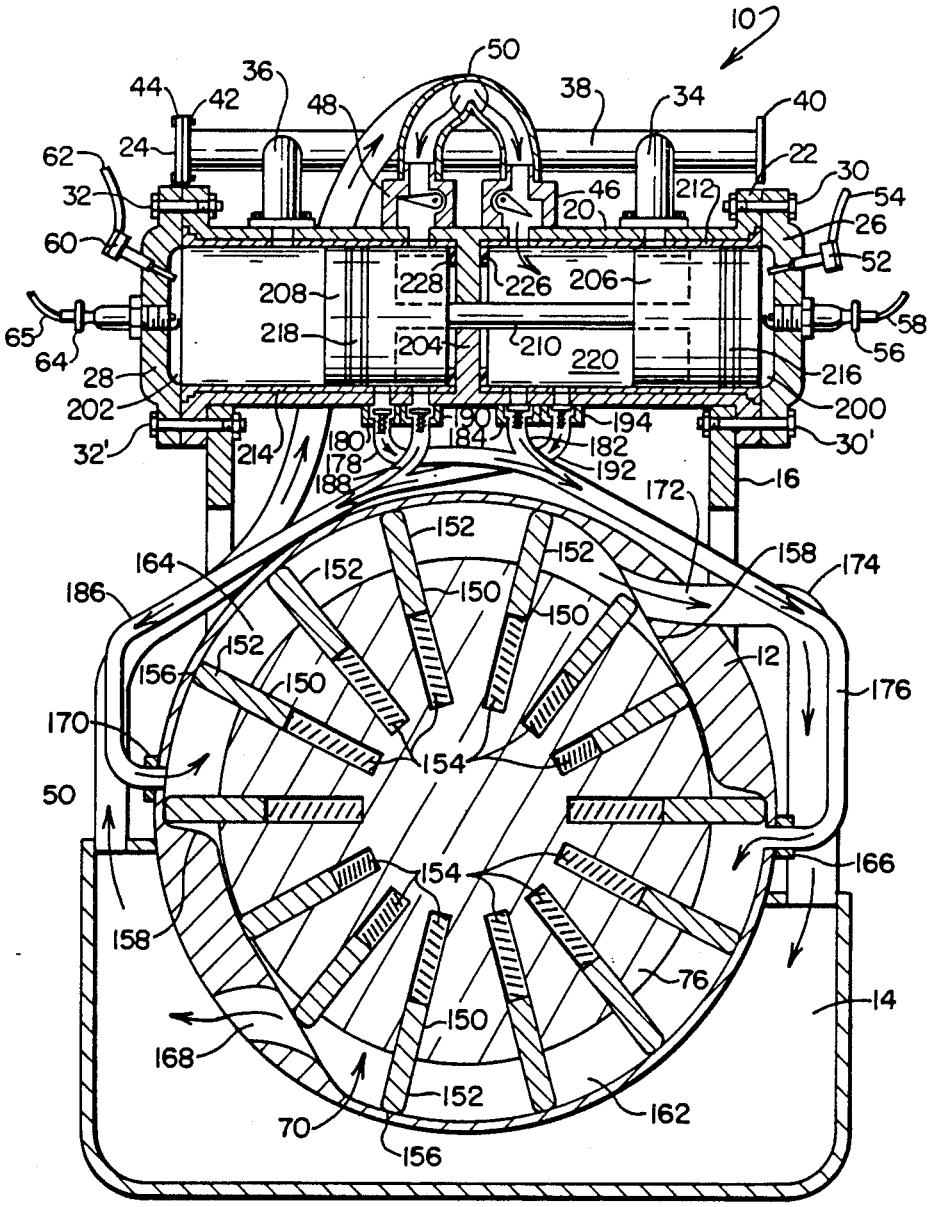
FIG. 3 is a sectional view of the engine of FIG. 1 taken through the plane 3—3 therein.

Referring to FIG. 1, a single modular unit internal combustion engine according to the invention is revealed generally at 10. The engine 10 is seen to be formed having a cylindrically shaped rotor housing 12, the bottom portion of which is mounted to a fluid return or reservoir 14. Mounted upon the upwardly disposed portion of housing 12 is one of two cylinder housing support brackets 16. The other such cylinder housing support bracket is seen in FIG. 2 at 18. Brackets 16 and 18 serve to support a cylindrically shaped cylinder housing represented at 20. FIG. 2 further reveals that the cylinder housing 20 is configured having integrally formed end flanges 22 and 24 to which are bolted respective cylinder heads 26 and 28. In the latter regard, head bolts, certain of which are identified at 30, are seen coupling cylinder head 26 to flange 22, while head bolts, certain of which are represented at 32 connect cylinder head 28 to end flange 24. FIGS. 1 and 3 reveal that certain of these head bolts as at 30' and 32' are of elongated dimension and serve to couple the cylinder housing 20 to respective brackets 16 and 18. FIG. 2 further reveals two exhaust pipes 34 and 36 extending from connections with opposite sides of cylinder 20 and leading to an exhaust manifold pipe 38. Pipe 38 is shown being configured having connecting flanges 40 and 42 at either end. Flange 42 is seen connected with a cover or block 44, as revealed in FIGS. 2 and 3. FIG. 2 further shows relatively adjacently spaced supply valve blocks or housings 46 and 48 coupled to cylinder housing 20 and from which extends a Y-shaped fluid supply conduit 50. The figure also reveals a fuel-air injection nozzle 52 extending through cylinder head 28 and shown fed from an input line 54. Immediately beneath injector 52 is a spark plug 56 with ingition input lead 58. In similar fashion, a fuel injection nozzle 60 is mounted in cylinder head 28 having an input line 62 communicating therewith. Immediately below nozzle 60 is a spark plug 64 activated from ignition line 66.

Returning to FIG. 1, a rotor represented in general at 70 is shown in phantom positioned within the rotor support housing 12. The rotor includes two spaced circular side plates 72 and 74 which are attached to an interiorly disposed rotor hub shown in FIG. 3 at 76. FIG. 1 reveals that the rotor support housing 12 extends outwardly from side plate 72 to a cylindrical edge region 78 and from side plate 74 to an edge region 80. Edge regions 78 and 80 are cylindrical and have mutually corresponding profiles. The interior outward surface of these edge regions 78 and 80 define cylindrically shaped receiving surfaces which are mutually corresponding or substantially identical in profile. This conforming arrangement is a function of the modularity aspect of the apparatus 10. To cover the side of the rotor support housing 12 at the edge region 78, an end cover represented generally at 82 is bolted thereover. In this regard, a sequence of mounting extensions, some of which are identified at 84 are formed integrally with the rotor housing 12. A cover plate component 86 is configured to carry a corresponding array of mounting extensions as at 88 and the assemblage is bolted together by nut and bolt connectors, some of which are represented at 90. Cover plate 86 has a circular periphery which corresponds with the outside diameter of rotor support structure 12 and attached thereto or formed integrally therewith and extending inwardly is an alignment component represented in phantom at 92. Component 92 may, for example, be provided as a circular disk-shaped boss, the cylindrical edges of which slide in mating adjacency with the corresponding receiving surfaces at edge region 78. Suitable seals are additionally provided such as gaskets or the equivalent to assure the integrity of the end cover 82. Extending outwardly from plate 86 is another alignment component 94 configured identically with internally disposed component 92. Formed centrally within the cover 82 is a shaft opening (not shown) and surmounting that opening is a collar 96 coupled to component 94 and a bearing 98 which, in turn, supports a drive shaft represented in general at 100. Drive shaft 100 is seen to include a base 102 which is connected to rotor plate 72 and may be integrally formed therewith. The shaft is seen to be supported from bearing 98 such that its axis is coaxial with that of the rotor 70. The shaft extends a predetermined uniform distance to an engaging shaft end portion 104 which is seen to carry grooves for tandem connection with additional units 10. Positioned between the end cover 82 and rotor plate 72 is a cavity 108. Depending upon the desires of the designer, it will be seen that this cavity 108 with fill with drive fluid (for example, hydraulic fluid) where the design elects not to provide a dynamic seal between rotor plate 72 and the corresponding internal surface of rotor support housing 12.

The other side of rotor support housing 12 is closed by an end cover represented generally at 112 and structured identically as that at 82. As before, the rotor support housing 12 is configured having an array of mounting extensions, certain of which are represented at 114 which are configured and arranged in identical fashion as those described at 84. End cover 112 includes a cover plate 116 structured in identical fashion as corresponding cover plate 86. Plate 116, as before, is formed having mounting extensions 118 extending outwardly therefrom in an array matching the array of corresponding mounting extensions 114. Thus, connection of plate 118 is made by bolt and nut connectors extending through mounting extensions 118 and 114, certain of which are represented at 120. Extending inwardly from cover plate 116 is an alignment component represented in phantom at 124 which is structured in identical manner as corresponding alignment component 92. In this regard, the component 124 is formed having a diameter extending to an internal receiving surface at edge region 80 of rotor support housing 12. An outwardly disposed aligning component 126 is formed outwardly of the cover plate 116 and is configured in the same manner, i.e. identically, as component 124. Positioned centrally of cover plate 112 is an opening (not shown) about which a bearing 132 is supported. Bearing 132, in turn, supports a drive shaft represented generally at 134 which includes a spacer portion 136 from which, in turn, extends to an engaging shaft end portion shown in phantom at 138 and structured in identical fashion as the corresponding end portion 104 of drive shaft 100. Shafts 100 and 134 support the rotor 70 in a manner where its axis is coaxially oriented with respect to the central axis of the rotor support housing 12. End portion 138 is configured for engagement with a corresponding shaft coupling portion of the rotor 70, extending into the hub 76 thereof (FIG. 3) and through side plate 74. The shaft 134 is retained in position by ring or collar 140 cooperating with the oppositely disposed flange portion of spacer 136. Thus, the end cover components 82 and 112 are fabricated identically to minimize fabrication costs and to enhance modularity as discussed later herein. With the arrangement, it may be observed that a cavity 144 similar to that at 108 is formed between the cover plate 112 and side plate 74 of rotor 70. No mounting brackets are revealed in connection with the device 10. However, such brackets may be applied depending upon the use and orientation of the engine 10 contemplated. In particular, it will be observed that the device 10 is capable of operation in essentially any orientation, being substantially gravity independent.

Turning to FIG. 3, the structure of rotor 70 is revealed in more detail. In the figure, the hub 76 of rotor 70 is seen to be configured having an array of regularly spaced radial slots, certain of which are represented at 150. Within these solts 150 are positioned vanes or plates, certain of which are represented at 152. Each of these vanes 152 is biased outwardly by one or more helical springs, certain of which are represented at 154, which reside in bores extending radially inwardly from slots 152. Each vane 152 is formed having an outwardly disposed wiping surface, certain of which are shown at 156, which are urged into contact with the contact surface 158 of a rotor receiving portion centrally disposed within rotor support housing 12. This rotor receiving portion contact surface 158 is configured with respect to the rotor 76 to define or develop two oppositely spaced fluid drive chambers 162 and 164. Fluid drive chamber 162 is shown having a fluid entrance port 166 and a fluid output port 168. Correspondingly, fluid drive chamber 164 is shown having a fluid entrance port 170 and a fluid output port 172. Fluid exit port 168 is seen in direct communication with fluid reservoir or return 14, while fluid exit port 172 extending from chamber 164 is coupled via conduit 174 to the reservoir 14. Correspondingly, fluid drive input to chamber 162 is derived from conduit 176 which extends along branch conduit 178 to check valve containing fluid output port 180 coupled with the underside of cylinder housing 20. Opposite branch 182 of conduit 176 similarly extends to a check valve containing fluid output port 184 also extending into cylinder housing 20. In similar fashion, fluid entrance port 170 is coupled by a conduit 186 and branch 188 to a check valve containing fluid output port 190, while branch 192 thereof is coupled to a check valve containing fluid output port 194. FIG. 3 further reveals that earlier described fluid supply conduit 50 extends from the reservoir or fluid return 14 to flap valve containing valve blocks 46 and 48.

With the arrangement shown, the flow under pressure of fluid within supply conduits 176 and 186, as represented by the arrows drawn thereon, will cause the counter-clockwise rotation of the rotor hub 76 and thus the rotor assembly 70. This fluid under pressure will exit to the reservoir 14 from ports 168 and 172. The type of fluid employed for this purpose may vary considerably, however, a hydraulic grade of oil is preferred.

The internal combustion component providing this fluid drive to the fluid drive component is developed from the internal combustion component structured around the cylinder housing 20. Housing 20 is seen to have two oppositely disposed piston chambers 200 and 202, each chamber having a retracted position adjacent or in the vicinity of a partition 204, as well as head locations or positions in the vicinity or adjacent to cylinder heads 26 and 28. A free piston 206 is located within piston chamber 200 and is connected by a piston rod 210 extending through partition 204 to piston 208 within chamber 202. Chambers 200 and 202 also are shown having cylinder sleeves or inserts shown, respectively, at 212 and 214. Paired piston rings at 216 are shown positioned over piston 206, while a corresponding piston ring pair 218 is seen positioned over piston 208. In the orientation shown, piston 206 is at the top of its single combustion stroke with the compression of air and fuel mixture developed from injector 52 under ignition from spark plug 56. As is apparent, separate air and fuel injectors may be employed for the noted purpose. In the configuration shown, fluid will have been drawn through the open flap valve of valve block 46 and conduit 50 from reservoir 14 into a fluid pump region represented at 220 positioned between the pump or rearwardly disposed portion of piston 206 and partition 204 or the retracted location of chamber 200. That portion of piston 206 extending toward cylinder head 26 from the paired piston rings 216 may be considered a combustion driven portion of the piston 206. Note in this fluid drawing orientation, the check valves at ports 184 and 194 are closed. By contrast, the piston 208 will have been driven towards the noted retracted location with a consequent closing of the flap valve at valve block 48 and the opening of the check valves at ports 180 and 190. As piston 208 is driven to the left in the sense of FIG. 3, check valves 180 and 190 will close, while the flap valve at block 48 will open to permit the ingress of fluid into the fluid pump region of piston chamber 202, that region being defined in the same manner as region 220. As the piston 208 is so driven, a scavenging form of exhaust removal is provided along with an ingress of fuel-air from injector 60. The cycle then repeats itself to provide motive fluid input to the rotor 70. In effect, a "one stroke" engine (combustion) approach is developed. That is, each of the two pistons of the engine module performs a power stroke after ignition. Piston stop rings 226 and 228 are shown in respective piston chambers 200 and 202. Where separate air and fuel injectors are employed, the combustion arrangement may provide for two air injections. One such air injection occurs at the end of a combustion driven stroke to facilitate the exhaust action. The other such air injection occurs in concert with the injection of fuel during compression.

In order to provide the structuring for the internal combustion component thus described, cylinder housing 20 necessarily must be formed of two parts. Looking to FIG. 4, this structuring is revealed. In the figure, it may be noted that the housing 20 is divided into two symmetrical parts represented at **20*a* and 20*b*. In the formation of the internal combustion device, the two halves are separated and the combined pistons and sleeves or inserts are inserted in one half, following which the second half is attached. The two halves are retained in the orientation shown in the figure by virtue of their coupling with the cylinder heads 26 and 28**. Suitable seals, for example liquid gaskets and the like, are provide which are not represented in the drawing.

The internal combustion apparatus 10 is ideally suited as a modular power unit within a series of such units. Thus, one design can be provided and manufactured at minimum cost. Where power demands are beyond the capacity of one element 10, then a tandem or cascading sequence of these modular units can be assembled with considerable ease. In this regard, the drive shaft output of one unit is utilized with the next and the combination of the two units is one wherein the commonly structured rotor housing covers are repositioned and, where appropriate, removable drive shaft 134 is dispensed with. Note in this regard, that drive shaft 100 preferably is fixed in position with respect to rotor 70, while the oppositely disposed drive shaft 134 is designed for removal from the device 10. In combining the units 10, it is preferred that the spaced fluid drive chambers as described at 162 and 164 in FIG. 3 be symmetrically displaced. In this regard, the chambers of a next succeeding two unit assembly would be displaced by 90° in a rotational sense. Similarly, where three such units are combined, a displacement of 30 rotational degrees would be provided to permit smoother operation. In complement with this arrangement, the ignition timing for the internal combustion components is configured to accommodate for this offsetting procedure.

Figure 5:
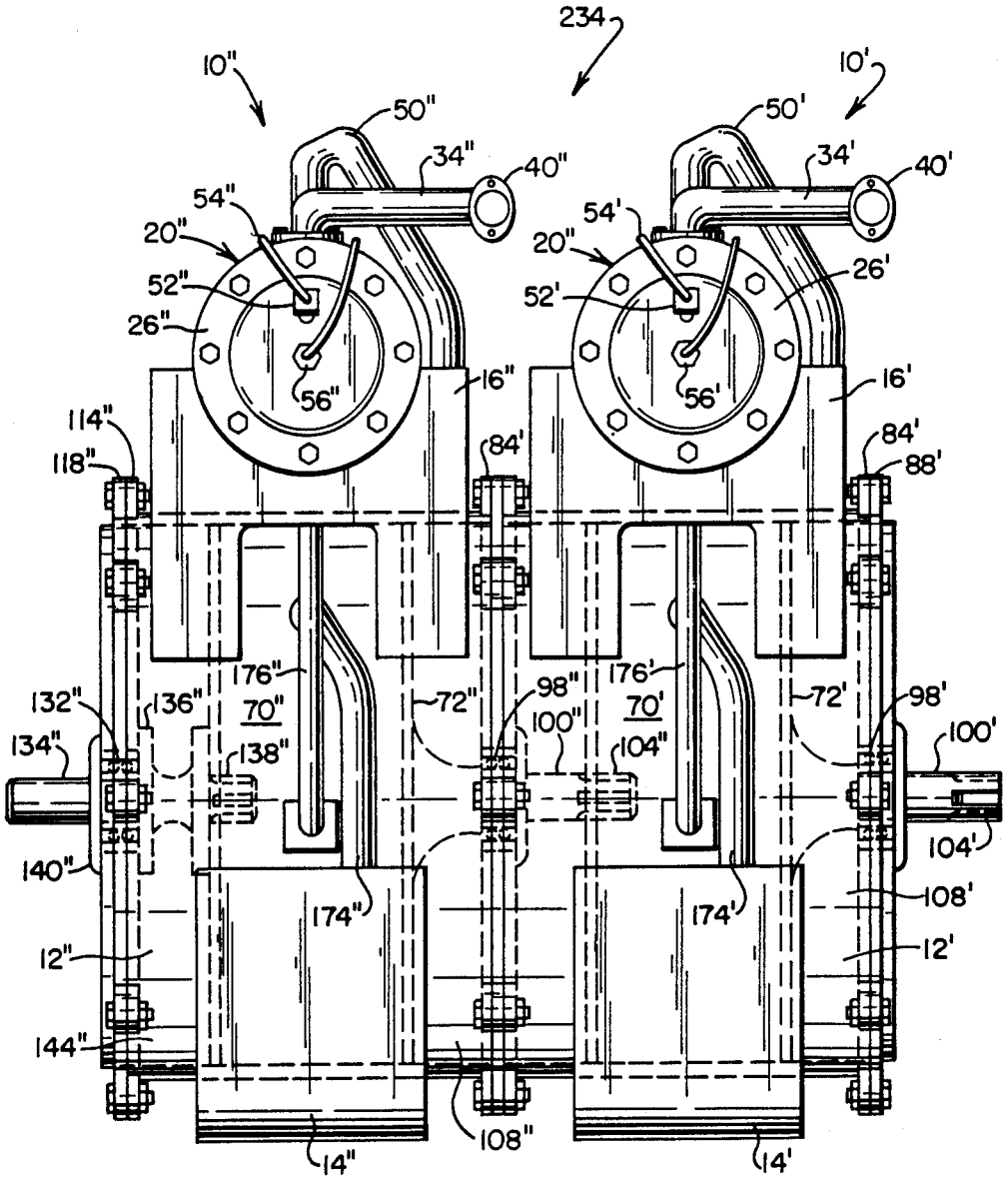
FIG. 5 is a side elevational view of a tandem coupling of engine modules according to the invention.

Referring to FIG. 5, a pair of internal combustion units 10 are depicted in a serial or tandem coupling and represented in general at 234. The figure at hand is one following the depiction of unit 10 represented and described above in connection with FIG. 1. Inasmuch as the advantage of the invention resides in a uniformity of design for each succeeding component, common features of the component 234 in FIG. 5 are represented in primed fashion for one unit as at unit 10' and in double primed fashion for the second unit as represented in general at 10". In the figure, it may be observed that the fixed drive shaft 100" as supported from bearing 98' has replaced the drive shaft 134 described in connection with FIG. 1. In particular, the engaging end portion 104" of drive shaft 100" now supports the rotor 70' at the rotor shaft coupling portion thereof. Thus, the rotors 70' and 70" are coupled in tandem.

Since certain changes may be made in the above system and apparatus without departing from the scope of the invention herein involved, it is intended that all matter contained in the above description or shown in the accompanying drawing shall be interpreted as illustrative and not in a limiting sense.

What is claimed is:

1. An internal combustion engine, comprising:

a fluid drive component, including:

a rotor housing having a rotor receiving portion including a substantially continuous peripheral internally disposed contact surface, a rotor having an axis of rotation mounted within said rotor receiving portion and configured with respect thereto to provide first and second spaced fluid drive chambers along said contact surface, drive shaft means for supporting said rotor for rotation about said axis of rotation and having a drive output, first and second entrance ports in fluid communication respectively with said first and second fluid drive chambers;

first and second exit ports in fluid communication respectively with said first and second fluid drive chambers, fluid return means for receiving fluid from said first and second exit ports;

an internal combustion component, including:

a cylinder housing having first and second oppositely disposed piston chambers, each extending from retracted positions to respective first and second head locations, first and second pistons slideably mounted within respective said first and second piston chambers, each said first and second positions having a combustion driven portion and an oppositely disposed pump portion, each said pump portion of said first and second pistons being movable to and from an associated said cylinder retracted position to define respective first and second fluid pump regions, a connector rod interconnecting said first and second pistons through said retracted positions, first and second internal combustion means for providing a combustion drive to said combustion drive portions of respective said first and second pistons to input a reciprocating drive thereto; and conduit means for providing fluid flow from said fluid return means to said first and second fluid pump regions when one of said first and second pistons is driven from a said retracted position, and for providing drive fluid flow from one of said first and second fluid pump regions to a respective said first and second fluid drive chamber when one of respective said first and second pistons is driven toward a said retracted position to impart driven rotational motion to said rotor.

2. The internal combustion engine of claim 1 including first and second fluid input ports in fluid communication with respective said first and second fluid pump regions of said first and second piston chambers and said fluid return means through said conduit means.

3. The internal combustion engine of claim 2 including first and second supply valve means coupled with respective said first and second input ports for respectively blocking fluid flow therethrough when one said respective first and second piston moves toward said retracted location.

4. The internal combustion engine of claim 3 in which said first and second supply valve means are flap valves.

5. The internal combustion engine of claim 1 including first and second fluid output ports in fluid flow communication with respective said first and second fluid pump regions of said first and second piston chambers and respective said first and second fluid drive chambers of said rotor housing through said conduit means.

6. The internal combustion engine of claim 5 including first and second drive valve means coupled with respective said first and second output ports for respectively blocking fluid flow therethrough when one said respective first and second piston moves away from said retracted position.

7. The internal combustion engine of claim 6 in which said first and second drive valve means are check valves.

8. The internal combustion engine of claim 5 including first and second fluid input ports in fluid communication with respective said first and second fluid pump regions of said first and second piston chambers and said fluid return means through said conduit means.

9. An assembly of two internal combustion engines having tandem coupled output drives comprising:

a first fluid drive component, including:

a first rotor support housing having a first given axis and extending between first and second edge regions at oppositely disposed sides thereof, each said side having a receiving surface of mutually corresponding profile, said first rotor support having housing a first rotor receiving portion positioned therewithin, a first end cover enclosing one said first rotor support housing side and having a first alignment component extending from the inwardly disposed surface thereof in aligning adjacency with said receiving surface of said first rotor support housing first edge region, a first shaft opening and a first bearing supported about said first shaft opening in coaxial alignment with said first given axis, a first rotor having first and second oppositely disposed sides, a rotor axis, being drivably rotatable about said axis within said first rotor receiving portion and configured with respect thereto to provide first and second spaced fluid drive chambers along said first rotor receiving portion, said first rotor second side including a first shaft coupling portion, a first drive shaft coupled to said first side of said first rotor coaxially with said first rotor axis, rotatably supported by said first bearing to support said first rotor with coaxial alignment between said first given axis and said rotor axis of said first rotor, and extending a predetermined distance to a first engaging shaft end portion, a second end cover enclosing the opposite said first rotor support housing side, having a second alignment component extending in aligning adjacency with the said internal receiving surface of said first rotor support housing second edge region, a third alignment component extending oppositely from said second alignment component and configured to correspond with said first alignment component, a second shaft opening and a second bearing supported about said second shaft opening in coaxial alignment with said first given axis; and a first internal combustion driven pump, including:

a first cylinder housing having first and second oppositely disposed piston chambers, first and second pistons mounted for movement within respective said first and second piston chambers, first conduit means in fluid communication between said first and second piston chambers and said first and second fluid drive chambers for configuring said first cylinder housing as a pump providing fluid drive to said first rotor, and first internal combustion means coupled with said first cylinder housing for providing a combustion induced drive to said first and second pistons to effect said fluid drive; and a second fluid drive component, including:

a second rotor support housing having a second given axis and extending between third and fourth edge regions at oppositely disposed sides thereof, each said side having a receiving surface of mutually corresponding profile corresponding with said first and second edge region profiles, said second rotor support housing having a second rotor receiving portion positioned therewithin and being coupled in coaxial relationship with said first rotor support housing by union of said third edge region with said second end cover and said third alignment component, a second rotor having oppositely disposed third and fourth sides, a rotor axis, being drivably rotatable within said second rotor receiving portion and configured with respect thereto to provide third and fourth spaced fluid drive chambers along said second rotor receiving portion, said second rotor fourth side including a second shaft coupling portion, a second drive shaft coupled to said third side of said second rotor coaxially with said second rotor axis, rotatably supported by said second bearing of said second end cover, extending a predetermined distance to a second engaging shaft end portion, said second engaging shaft end portion being coupled with said first shaft coupling portion of said first rotor to support said first and second rotors in axial alignment, a third end cover enclosing said second rotor support housing at said fourth edge region, having a fourth alignment component extending from the inwardly disposed surface thereof in aligning adjacency with said receiving surface of said second rotor support housing fourth edge region, a third shaft opening and a third bearing supported about said third shaft opening in axial alignment with said rotor axis of said second rotor, a thid drive shaft coupled to said fourth side of said second rotor at said second shaft coupling portion, rotatably supported by said third bearing to support said second rotor with coaxial alignment between said second given axis and said axis of said second rotor; and a second internal combustion driven pump, including:

a second cylinder housing having third and fourth oppositely disposed piston chambers, third and fourth pistons mounted for movement within respective said third and fourth piston chambers, second conduit means in fluid communication between said third and fourth piston chambers and said third and fourth fluid drive chambers for configuring said second cylinder housing as a pump providing fluid drive to said second rotor, and second internal combustion means coupled with said second cylinder housing for providing a combustion induced drive to said third and fourth pistons to effect said fluid drive.

10. The assembly of claim 9 in which said first and second drive shafts respectively are fixed to said first and second rotors.

11. The assembly of claim 9 in which said second drive shaft second engaging shaft end portion is coupled with said first rotor by removably insertion within said first shaft portion thereof.

12. The assembly of claim 9 in which said first and second drive shafts are substantially identically configured.

13. The assembly of claim 9 in which said first end cover and said third end cover are configured substantially identically with said second end cover so as to reduce part variation for said assembly.

* * * * *